US006523617B2

(12) United States Patent
McGugan

(10) Patent No.: US 6,523,617 B2
(45) Date of Patent: Feb. 25, 2003

(54) MOTOR GRADER VEHICLE CONTROL ARRANGEMENT

(75) Inventor: Edward McGugan, Holyrood (CA)

(73) Assignee: Volvo Motor Graders Limited, Gudench (CA)

( * ) Notice: Subject to any disclaimer, the term of this patent is extended or adjusted under 35 U.S.C. 154(b) by 54 days.

(21) Appl. No.: 09/990,338

(22) Filed: Nov. 23, 2001

(65) Prior Publication Data

US 2002/0060081 A1 May 23, 2002

(51) Int. Cl.[7] ..... E02F 3/76

(52) U.S. Cl. ..... 172/4.5; 172/780; 172/796; 172/797; 701/50; 37/234; 37/382; 37/906

(58) Field of Search ..... 37/234, 381, 382, 37/906; 701/50; 172/4.5, 2, 779, 780, 781, 795, 796, 797

(56) References Cited

U.S. PATENT DOCUMENTS 3,077,682 A * 2/1963 Small ..... 37/143
3,585,319 A * 6/1971 Payerle et al.
3,907,041 A * 9/1975 Manor ..... 172/80
4,237,629 A * 12/1980 Schmidt ..... 37/41
4,821,837 A * 4/1989 Fifer ..... 180/334
4,889,466 A * 12/1989 Jindai et al. ..... 172/4.5 X
5,152,329 A * 10/1992 Browne et al. ..... 172/4.5 X
5,363,304 A * 11/1994 Awano et al. ..... 172/4.5 X

FOREIGN PATENT DOCUMENTS

JP 5-51916 * 3/1993
JP 5-149079 * 6/1993

* cited by examiner

*Primary Examiner*—Christopher J. Novosad

(57) ABSTRACT

An intuitive control for a motor grader controls the blade high lift assembly by adjustment of a miniature representation available at the operator's station. This miniature representation allows the direction of adjustment of various hydraulic components to be made by moving the representation in the desired directions. The control is intuitive in that it corresponds to the actual high lift assembly. A similar miniature representation can be used for controlling the steering of the motor grader.

14 Claims, 6 Drawing Sheets

30
40
90

MOTOR GRADER VEHICLE CONTROL ARRANGEMENT

FIELD OF THE INVENTION

The present application relates to motor grader controls and in particular, relates to motor grader controls which are more intuitive to operate.

BACKGROUND OF THE INVENTION

Motor graders are relatively complicated and require considerable operator skill to fully utilize the capabilities of the machine. Traditionally, the various components of the grader are controlled by manual shift levers which are associated with hydraulic control valves for adjusting hydraulic components. These control levers are typically mounted for movement in the fore and aft direction of the motor grader.

Mechanical control systems of this type are most common, however, there has been concern with respect to operator fatigue and the actual operator movement necessary to actuate the hydraulic components.

More recently, it has been proposed to use joy stick type controllers for controlling the various functions of the motor grader. Unfortunately, the controller becomes quite complicated and is not intuitive with respect to the operation of the grader.

SUMMARY OF THE INVENTION

The present invention seeks to overcome a number of these difficulties and provide a control arrangement which is more intuitive with respect to the components being controlled.

The present invention provides an operator control arrangement for controlling a blade suspended beneath the frame of a grader and moveable beneath the frame of the grader to various adjusted positions by means of at least a blade lift arrangement, a blade rotation arrangement and a blade slide arrangements. The operator control arrangement comprises a miniature representation of a motor grader blade support arrangement which controls the position of the blade of the motor grader. The miniature representation is controlled by one hand of the operator and includes a visually identifiable blade representation which is moveable in a sliding manner and controls the slide movement of the blade. This blade representation is also rotatable about a normally vertical axis and controls the angle of the blade relative to the grader frame. The blade representation also controls high lift cylinders of the grader blade by moving of the visually identifiable blade representation in a vertical plane to sense the desired direction of adjustment of the high lift cylinders of the motor grader.

With this control arrangement, the operator adjusts the position of the blade of the motorgrader by adjusting the position of the miniature representation of the motor grader support arrangement which allows the operator to impart the direction of change to the component of the blade support arrangement.

In an aspect of the invention, the miniature representation is universally pivoted at a forward end by means of an elongate member which corresponds to a draw bar of the motor grader.

In a further aspect of the invention, the operator control arrangement is biased to a neutral position and movement of the control out of the neutral position requires the operator to exert a force to overcome the bias and thereby initiate adjustment of the grader blade in the direction of the force. The control arrangement returns to the neutral position upon removal of the exerted force.

In yet a further aspect of the invention, the control arrangement has the blade representation slidable beneath a ring gear representation which is pivotally secured to the elongate member and is movable about the pivot in a first direction to initiate rotation of the ring gear in a first direction and movable about the pivot in the opposite direction to initiate rotation of the ring gear in a direction opposite to the first direction of the ring gear movement.

In yet a further aspect of the invention, the control arrangement includes two position sensing links either side of the elongate member which correspond to high lift cylinders of the blade lift arrangement. The position sensing links sense movement of the ring gear representation to adjust the height of the ring gear and the angle of the ring gear of the representation. In this way, both high lift cylinders can either extend or retract together, or one high lift cylinder can be extended while the other high lift cylinder is contracted.

In yet a further aspect of the invention, movement of the control arrangement from the neutral position closes at least one switch which causes at least one hydraulic member of the blade support arrangement to adjust the position to the blade support arrangement in a sympathetic manner and direction.

In yet a further aspect of the invention, movement of the control arrangement can simultaneously initiate movement of the blade, said high lift cylinders and said ring gear.

The miniature representation is based on a neutral position and senses the direction of change being imparted by the operator when the miniature representation is moved from the neutral position. The actual amount of representation is relatively small as it is only sensing the direction of movement rather than the actual position of the blade support arrangement. The miniature representation is directly related to the actual blade support arrangement and as such the actual operator quickly understands the control. Preferably this miniature representation is secured to the operator chair adjacent one arm of the operator chair such that the arm of the operator is supported during use of the control. As can be appreciated, the one hand control with experience can impart a movement to the control which will adjust many of the hydraulic components of the actual blade lift support arrangements. The control arrangement has a dead region about the neutral position and the operator must move the representation out of the neutral position to effect the adjustment of the blade support arrangement.

In yet a further aspect of the invention, a miniature representation of the grader frame with the front wheels is provided at the opposite arm of the operator chair. This miniature representation includes two front wheels which can be steered as well as angled to correspond to the operator controls for the front steering. The operator can steer the grader by turning the front wheels as required to impart a turning direction and also angle the front wheels as desired to control the operational characteristics of the grader.

In a preferred aspect of the invention, the steering control representation also includes a release button which allows movement of the representation of the grader frame from a neutral position to control the articulation of the grader frame. The use of a release button is preferred to ensure the operator desires this feature to be initiated.

In a preferred aspect of the blade support arrangement, there is also a release button associated with the draw bar which when activated allows the draw bar to be shifted from side to side. This corresponds to a side shift control of the ring gear and allows movement of the ring gear beneath the actual grader frame from side to side in accordance with the direction imparted by the operator. Again, the release button ensures the operator desires to exercise this particular control over the blade lift arrangement.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
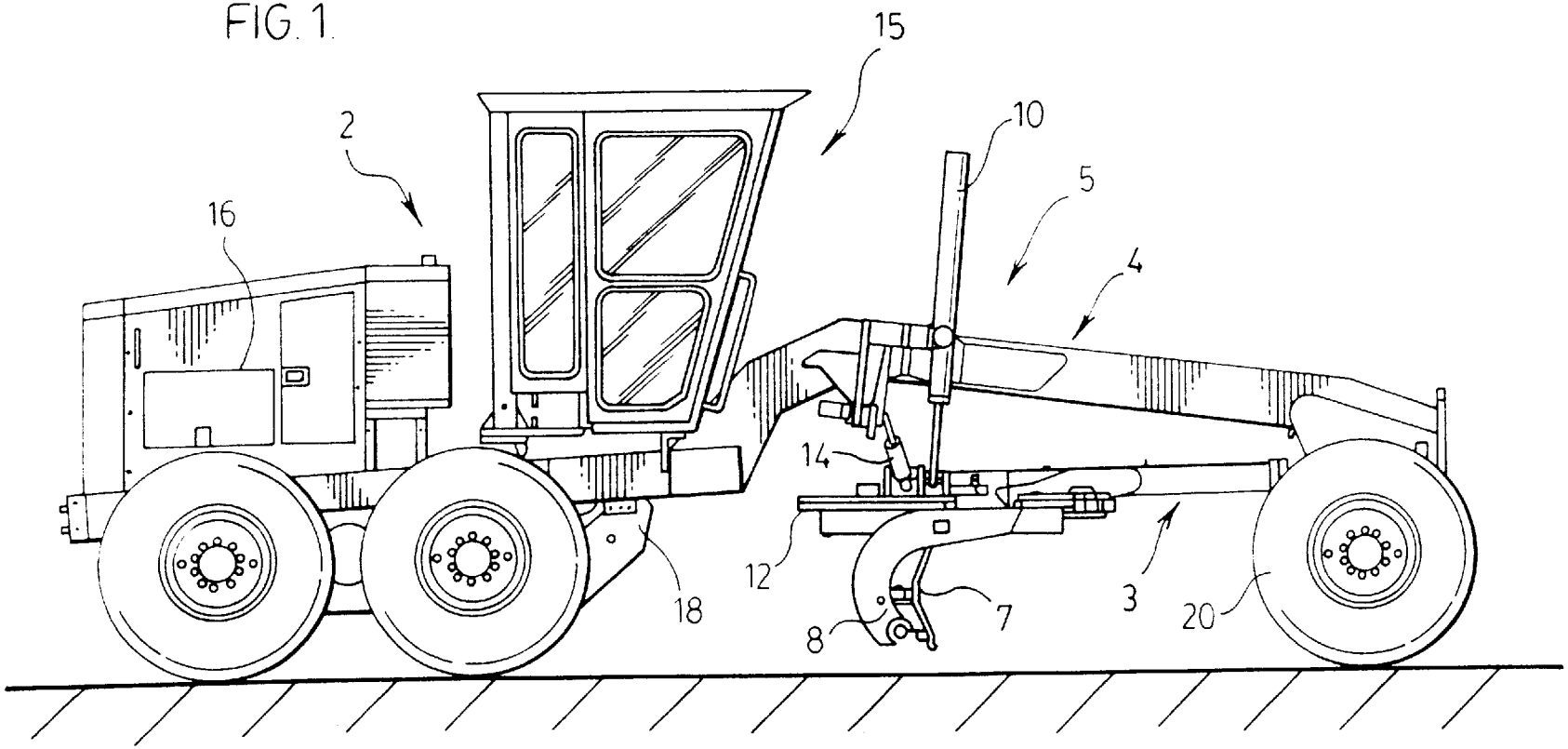
FIG. 1 is a side view illustrating a motor grader having a blade high left arrangement.
Figure 2:
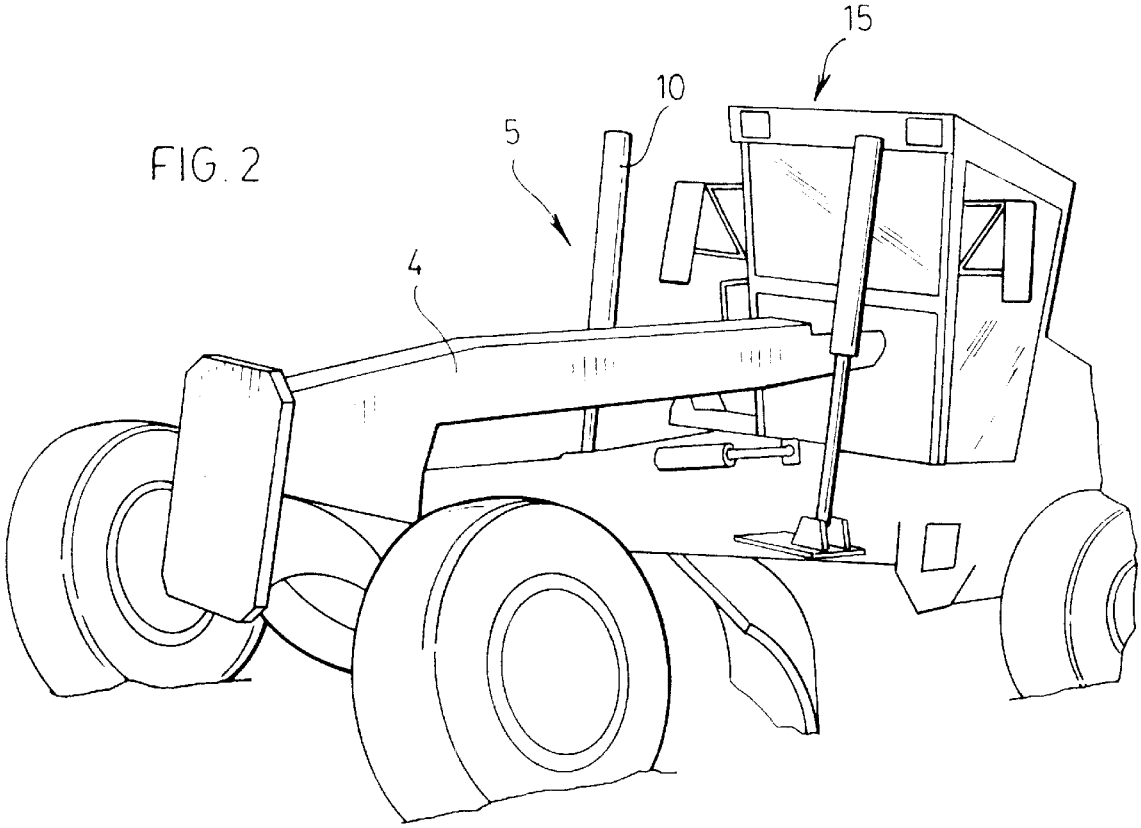
FIG. 2 is a partial perspective view of a motor grader similar to FIG. 1 illustrating the feature that the front wheels are capable being angled as well as turned.
Figure 3:
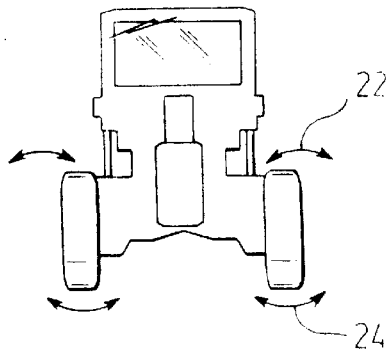
FIG. 3 is a front view of the motor grader illustrating the wheel control.

The motor grader 2 shown in FIGS. 1 through 3, includes a blade high lift arrangement 5 generally located at the free end of the draw bar 3 which is universally mounted at the nose of the motor grader. The motor grader has a forwardly extending frame 4 which supports the steerable and tiltable front wheels 20. The blade high lift arrangement 5 includes a slidable blade 7 which is also tiltable by means of the blade tilt arrangement 8 and is movable to various angled positions in the vertical plane by adjustment of opposed high lift cylinders 10. The ring gear 12 is rotatable beneath the draw bar 3 and thus, the attack angle of the blade can be adjusted. In addition, there is a side shift cylinder 14 for moving the ring gear either side or directly beneath the forward extending frame 4.

The motor grader includes a cab 15 located forward of the rear drive unit 16. A pivot point 18 connects the forwardly extending frame 4 to the drive unit 16. This arrangement allows articulation of the forwardly extending frame 4 relative to the rearward drive unit 16.

As more clearly shown in FIGS. 2 and 3, the front wheels 20 of the motor grader can be angled from side to side as illustrated by arrows 22 and are also steerable as illustrated by arrows 24.

Figure 4:
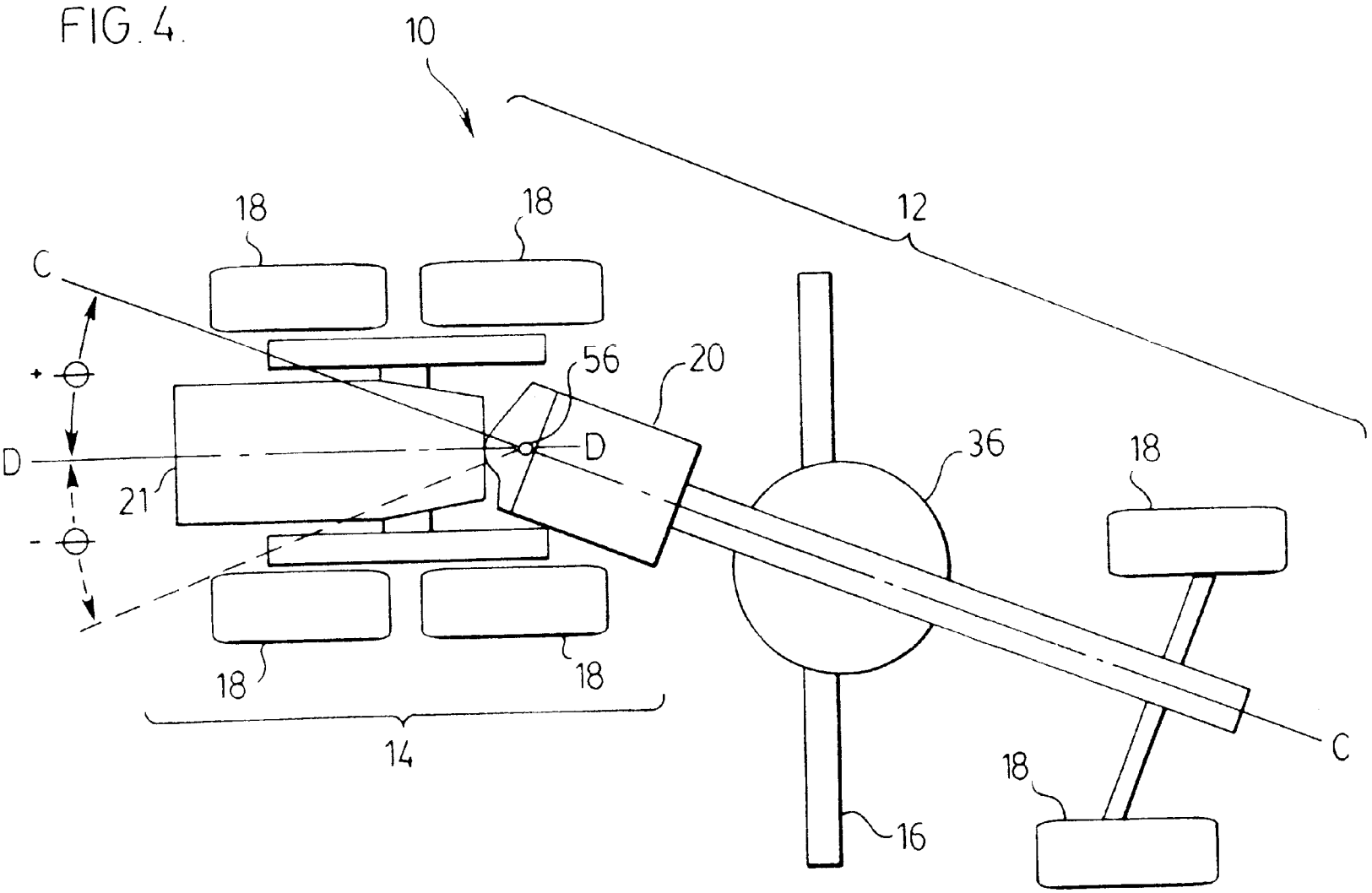
FIG. 4 is a top view showing the motor grader where the frame has been articulated for shifting the drive section of the motor grader to one side of the front wheels.

The articulation of the motor grader is shown in the top view of FIG. 4 where the forwardly extending frame is at an angle relative to the drive unit 16 and the front wheels have been rotated to allow the motor grader to move in a straight line. If the front wheels 20 were rotated in the opposite direction, this articulation would allow the grader to go around a much tighter corner. For any applications, the motor grader frame will not be in an articulated position and will be locked in the neutral position. From time to time, and depending upon the particular operating conditions, it is desirable to operate the grader with the frame articulated.

From FIGS. 1 through 4, it can be appreciated that the motor grader is basically steered primarily due to the position of the front wheels 20 and whether the grader frame is in an articulated position. Another important feature is the ability to tilt the front wheels from side to side to improve the operating characteristics. Thus, the steering arrangement of the motor grader is more complicated than many construction vehicles.

The second important aspect that can be appreciated from the Figures is the blade high lift arrangement 5 has many controls including the slidable position of the blade beneath the motor grader frame, the tilt of the blade in the vertical plane, the angle of the blade beneath the grader frame controlled by the ring gear, the height and angle of the blade in the vertical plane control by the high lift cylinders and the position of the ring gear relative to the grader frame controlled by the side shift cylinder. Basically, all of these components are controlled by a hydraulic control arrangement which was previously adjusted by means of actuation levers.

Figure 5:
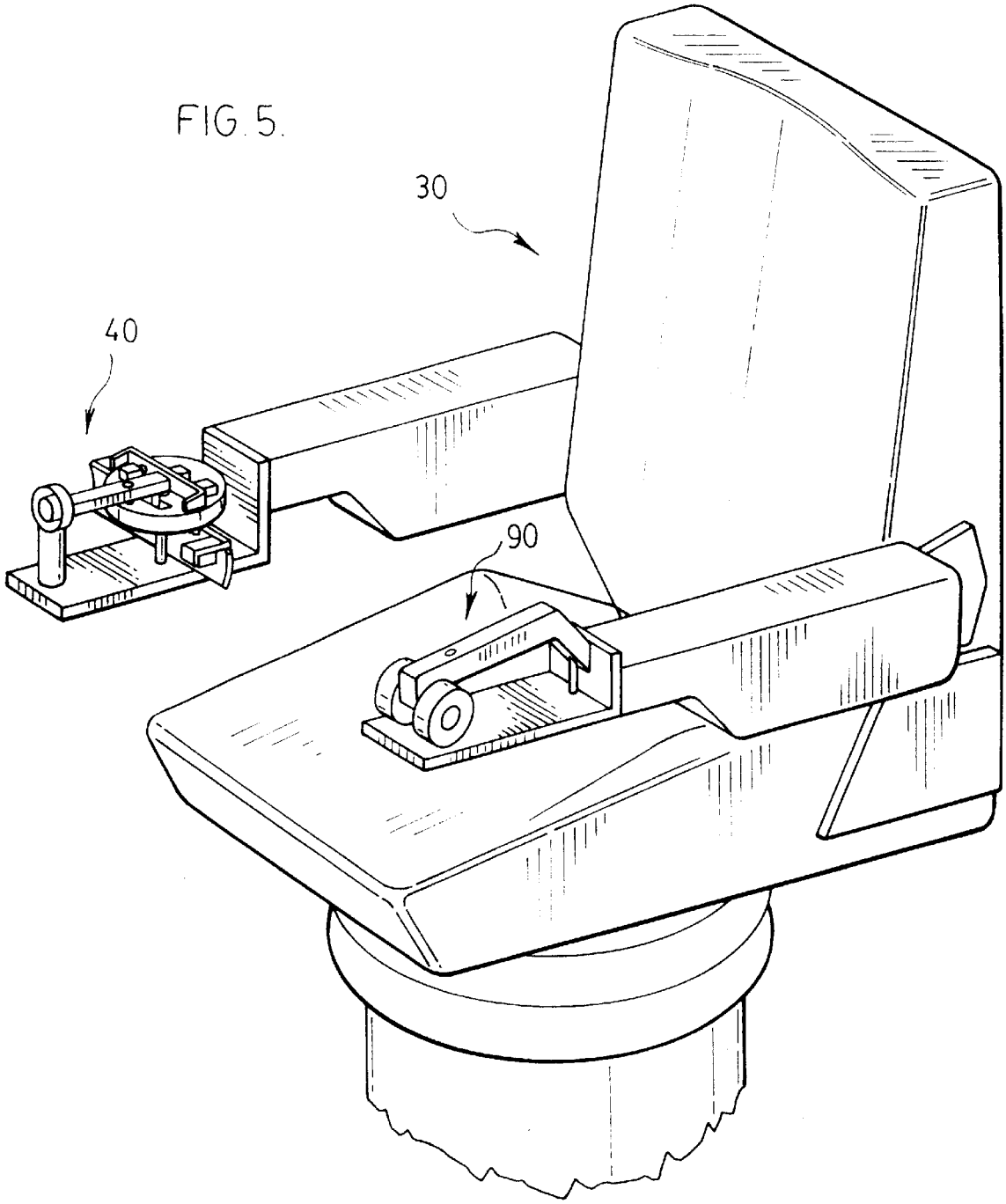
FIG. 5 is a schematic representation of the operator control station with a blade high lift control on the right hand arm and a motor grader steering control on he left hand arm.

The operator station shown in FIG. 5 has a miniature representation of the blade high lift assembly provided adjacent the right arm of the operator chair and a miniature representation of the forward portion of the grader frame and front wheels provided at the left hand control. The operator can adjust the high lift assembly 5 by adjustment of the miniature representation provided at the right arm and can effectively steer the motor grader by controlling the miniature representation provided on the left. These miniature representations have on/off controls for adjusting the position of the various hydraulic components. Both controls are biased to a neutral position. As such, these controls do not actually correspond to the actual position of the blade high lift 5 or the front steering components of the motor grader but are used to change the position of these components. The operator control station is shown as 30 and the blade high lift control is shown as 40, and the steering arrangement is shown as 80.

Figure 6:
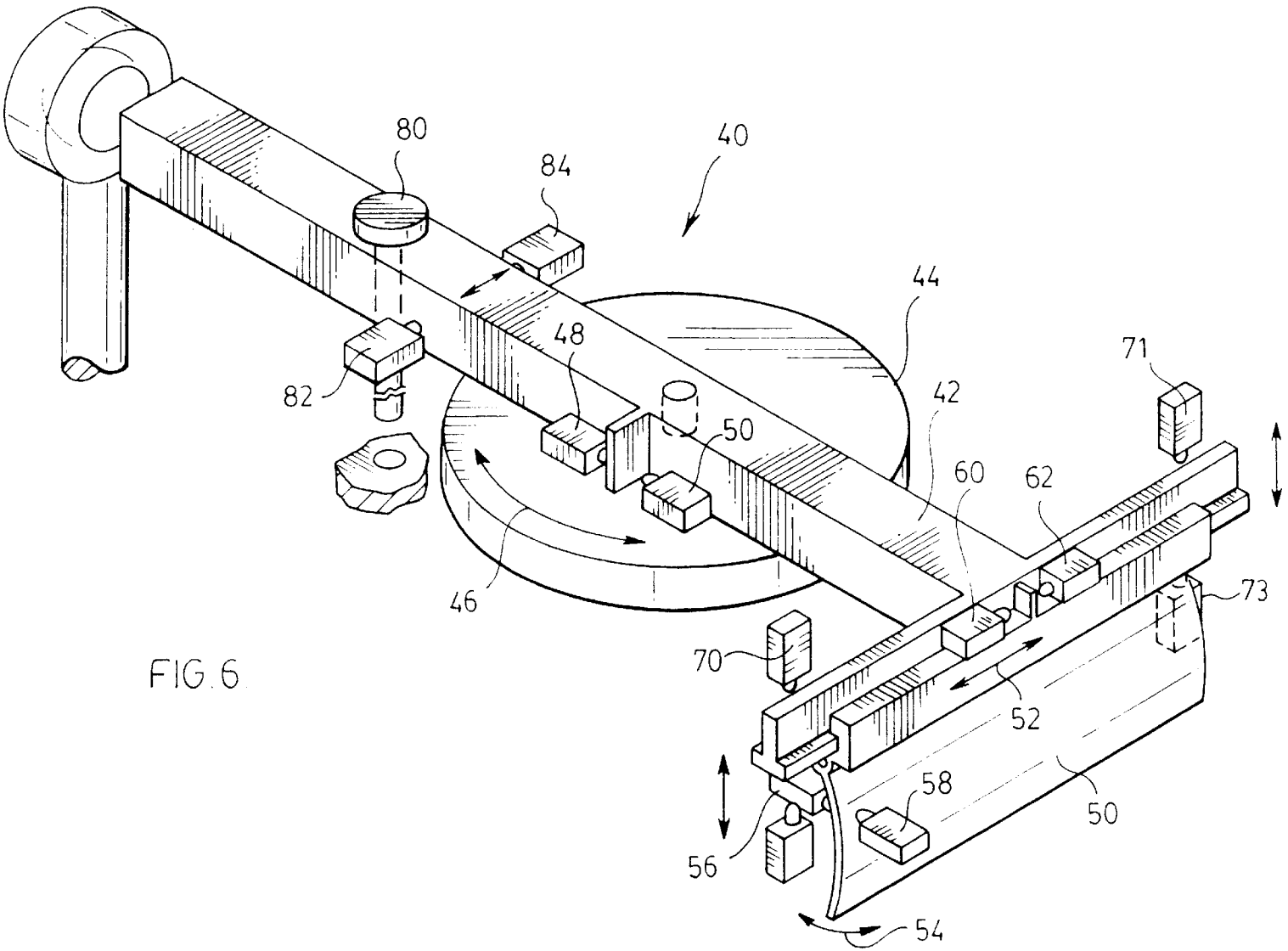
FIG. 6 is a schematic representation of the lade high lift control.

FIG. 6 shows the various control functions of the miniature representation 40 for the blade high lift assembly. The miniature representation 40 controls the direction of change of the various elements. In this case, a bar 42 corresponds to the draw bar of the motor grader. Pivoted beneath the bar 42 is a ring gear 44 which can be moved through a small angle indicated by the arrows 46. Movement of the ring gear 44 in a clock wise direction causes switch 48 to be actuated. This switch will then cause the ring gear to move in a clockwise direction until the operator releases element 44 and allows it to return to the neutral position. If the operator moves the ring gear 44 in a counter clockwise direction, switch 50 is actuated and the actual ring gear of the motor grader is rotated in a counter clockwise direction.

The sketch shown in FIG. 6 includes the blade representation 50 behind the ring gear component 44. It can either be behind this component or actually underneath the ring gear component to more clearly correspond to the actual high lift arrangement 5. The blade 50 is slidable in the directions shown as arrows 52 and correspond to the blade slide arrangement. In addition, it is tiltable as shown by arrows 54. Again these are on/off controls and movement of the blade forward causes switch 56 to be activated whereas movement of the lower edge of the blade rearwardly causes switch 58 to be actuated. Sliding movement of the blade to the left causes switch 60 to be actuated and sliding movement of the blade to the right causes switch 62 to be activated. As can be appreciated, the operator can control both the angle of the blade and the slide position of the blade at the same time.

Switches 70 and 72 control the high lift cylinder located to the left hand side of the grader frame and switches 71 and 73 control the high lift cylinder located to the right of the frame. If the miniature representation is moved upwardly, switches 70 and 71 will each be actuated. This will result in the high lift cylinders being retracted and the blade being lifted beneath the grader frame. If the control is moved downwardly, switches 72 and 73 are actuated and thus, the blade is lowered by the high lift cylinders, both extending. It is also possible to provide a change in the angle of the blade beneath the grader frame by retracting one high lift cylinder and extending the other.

For example, if the draw bar is moved such that switch 70 is closed and switch 73 is closed, the left hand high lift cylinder will contract and the right hand high lift cylinder will extend. In this way, switches 70 through 73 control the high lift cylinders of the motor grader to work in unison or in opposition.

FIG. 6 also includes a release actuator 80 which is depressed to allow movement of the bar member 42 from side to side. This sideward movement of the bar member 42 is sensed by switches 82 and 84. These switches control the articulation of the grader frame. The purpose of the release button 80 is to make sure that the operator truly wants to articulate the frame as opposed to merely an inadvertent shifting of bar member 42. When switch 82 is closed by movement of the bar member 42, the front wheels of the motor grader will be offset to the right hand side of the grader whereas when switch 84 is closed, the wheels will be offset to the left hand side of the grader.

As can be appreciated from FIG. 6, the miniature representation of the blade high lift arrangement provides the operator with an intuitive control arrangement for controlling the high lift. This miniature representation is biased to a neutral position whereby the device returns to this neutral position when the operator removes his bias from the control arrangement. Return to the neutral position stops any further adjustment of the particular hydraulic component or components. With this arrangement, control of the hydraulic components is accomplished by moving the miniature representation in a manner corresponding to the desired movement of the blade high lift arrangement.

Figure 7:
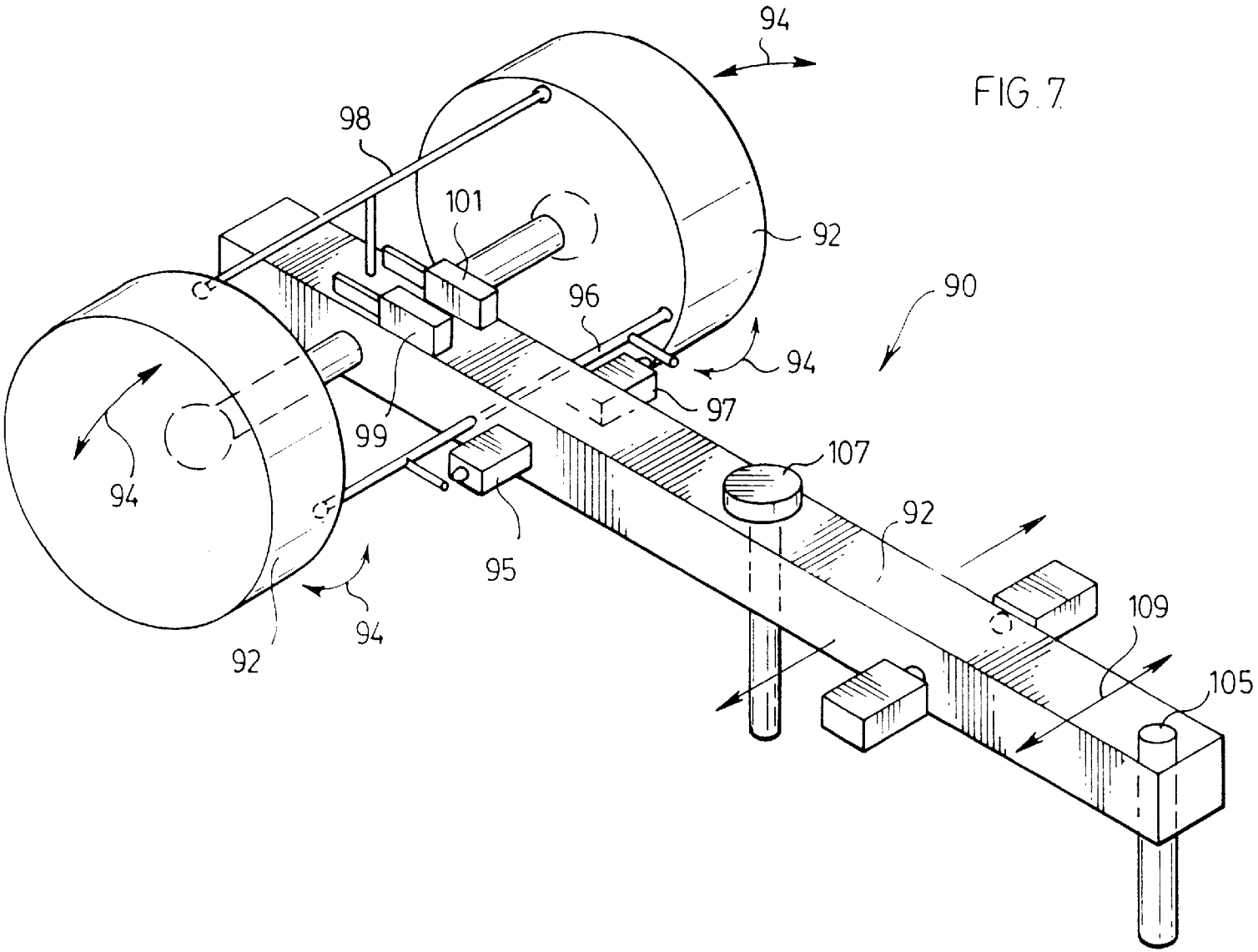
FIG. 7 is a schematic representation of the steering control for the motor grader.

FIG. 7 shows the miniature representation used to control steering of the motor grader. This steering control can be an alternative to the normal steering wheel or the control can be the primary steering control arrangement. The miniature representation for steering is shown as 90 and includes a elongate bar 92 which corresponds basically to the frame grader. Two front wheels are provided and shown as 92. These wheels correspond with the front wheels of the motor grader.

The wheels are steerable as indicated by arrows 94 to effect normal turning of the front wheels. The wheels 92 are also tiltable as indicated by arrows 94 to effect angling of the front wheels. It can be seen that the control bar 96 for effecting steering of the front wheels is on a neutral axis relative to the angle of tilt. Similarly, the control bar 98 for controlling the angle of the front wheels is located on a neutral axis relative to the angle of tilt. The operator can steer the front heels by merely moving the front wheels 92 to effect steering and at the same time, control angling of the front wheels by tilting the wheels in the desired direction. Switches 95 and 97 control the steering of the front wheels and when the front wheels are moved to close switch 95, the actual front wheels of the motor grader are moved to turn to the left whereas when switch 97 is closed, the actual wheels of the motor grader are turned to effect turning to the right. Switch 99 when actuated will cause angling of the top of the wheels towards the left and closing switch 101 will cause angling of the top of the front wheels to the right.

The bar 92 is secured to the operator control and is pivotable about shaft 105. In addition, there is a release actuator 107 which maintains the bar 92 in a neutral position. Actuation of release actuator 107 allows the bar 92 to pivot about shaft 105 as indicated by the arrows 109. This allows the operator to control articulation of the grader frame. Movement of the bar 92 to effect a counter clockwise movement of bar 92 will offset the wheels of the grader to the left hand side of the grader whereas a counter clockwise movement will articulate the grader frame such that the wheels are to the right of the grader frame.

From the above, it can be appreciated that the controls of the motor grader are now accomplished by manipulation of miniature representations of the actual controlling components of the motor grader. In particular, the blade high lift assembly is controlled by a miniature representation that is moved in the directions that the high lift blade assembly can be moved. As such, the operator will be able to impart the desired movement by imparting the direction of movement to the miniature representation. It has been found that this control arrangement reduces the complexity of the controls for a motor grader and is less intimidating to a new operator. Furthermore, it can be appreciated that these control arrangements are all based on the movement of switches which can either be on/off switches or progressive switches.

In the case of on/off switches, it is also possible to have different settings for the different operator skills. For example, for fine control it may be desired to have a setting whereby the actual movements only produce slow adjustment to the hydraulic components whereas a different setting would produce more rapid adjustment. These various settings can be adjusted by a separate control arrangement. This separate control arrangement can also include operator settings such as novice operator where controls including the side shift of the blade and/or the articulation of the frame are disabled or greatly reduced.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. In a motor grader having a blade suspended beneath a frame of the grader and movable beneath the motor grader frame to various positions by means of at least a blade lift arrangement, a blade rotation arrangement, and a blade slide arrangement using an operator control arrangement, said operator control arrangement comprising a miniature representation of a motor grader blade support arrangement which controls the position of the blade of a motorgrader, said miniature representation being controlled by a single hand of the operator, said miniature representation including a blade representation which is of a shape to visually identify the blade representation as controlling the blade of the grader, said blade representation being movable in a sliding manner to control a corresponding slide movement of the blade, said visually identifiable blade representation also being rotatable about a normally vertical axis to adjust the angle of the blade relative to the grader frame, said visually identifiable blade representation also controlling high lift cylinders of the grader blade by moving of the visually identifiable blade representation in the vertical plane to control the height of the grader blade and angle of the grader blade in the vertical plane by adjustment of high lift cylinders of the motor grader, whereby the operator adjusts the position of the blade of the motor grader by adjustment of the position of the miniature representation of the motor grader support arrangement.

2. In a motor grader as claimed in claim 1 wherein said operator control arrangement is biased to a neutral position and movement of said control arrangement out of said neutral position requires the operator to exert a force to overcome the bias and thereby initiate adjustment of said grader blade, and wherein said control arrangement returns to said neutral position upon removal of said exerted force.

3. In a motor grader as claimed in claim 2 wherein said control arrangement has said blade representation slidable beneath a ring gear representation which is pivotally secured to said elongate member and movable about said pivot in a first direction to initiate rotation of said ring gear in a first direction and movable about said pivot in the opposite direction to initiate rotation of said ring gear in an direction opposite to said first direction of ring gear movement.

4. In a motor grader as claimed in claim 3 wherein said control arrangement includes two position sensing links either side of said elongate member which correspond to high lift cylinders of said blade lift arrangement, said position sensing links sensing movement of said ring gear representation to adjust the height of the ring gear and the angle thereof.

5. In a motor grader as claimed in claim 4 wherein said control arrangement includes a releasable lock for maintaining the elongate member centered in a neutral position with respect to side to side movement, and wherein release of said lock allows movement of said elongate member either side of said neutral position to initiate movement of a side shift cylinder of said ring gear in the same direction.

6. In a motor grader as claimed in claim 2 wherein movement of said control arrangement from said neutral position closes at least one switch which causes at least one hydraulic member of said blade support arrangement of adjust the position to said blade support arrangement in a sympathetic manner and direction.

7. In a motor grader as claimed in claim 6 wherein movement of said control arrangement can simultaneously initiate movement of said blade, said high lift and said ring gear.

8. In a motor grader having a blade suspended beneath a frame of the grader and movable beneath the motor grader frame to various positions by means of at least a blade lift arrangement, a blade rotation arrangement, and a blade slide arrangement using an operator control arrangement, said operator control arrangement comprising a miniature representation of a motor grader blade support arrangement which controls the position of the blade of a motorgrader, said miniature representation being controlled by a single hand of the operator, said miniature representation including a blade representation which is of a shape to visually identify the blade representation as controlling the blade of the grader, said blade representation being movable in a sliding manner to control a corresponding slide movement of the blade, said visually identifiable blade representation also being rotatable about a normally vertical axis to adjust the angle of the blade relative to the grader frame, said visually identifiable blade representation also controlling high lift cylinders of the grader blade by moving of the visually identifiable blade representation in the vertical plane to control the height of the grader blade and angle of the grader blade in the vertical plane by adjustment of high lift cylinders of the motor grader, whereby the operator adjusts the position of the blade of the motor grader by adjustment of the position of the miniature representation of the motor grader support arrangement and wherein said miniature representation is universally pivotted at a forward end by means of an elongate member which corresponds to a draw bar of the motor grader.

9. In a motor grader as claimed in claim 8 wherein said operator control arrangement is biased to a neutral position and movement of said control arrangement out of said neutral position requires the operator to exert a force to overcome the bias and thereby initiate adjustment of said grader blade, and wherein said control arrangement returns to said neutral position upon removal of said exerted force.

10. In a motor grader as claimed in claim 9 wherein said control arrangement has said blade representation slidable beneath a ring gear representation which is pivotally secured to said elongate member and movable about said pivot in a first direction to initiate rotation of said ring gear in a first direction and movable about said pivot in the opposite direction to initiate rotation of said ring gear in an direction opposite to said first direction of ring gear movement.

11. In a motor grader as claimed in claim 10 wherein said control arrangement includes two position sensing links either side of said elongate member which correspond to high lift cylinders of said blade lift arrangement, said position sensing links sensing movement of said ring gear representation to adjust the height of the ring gear and the angle thereof.

12. In a motor grader as claimed in claim 11 wherein said control arrangement includes a releasable lock for maintaining the elongate member centered in a neutral position with respect to side to side movement, and wherein release of said lock allows movement of said elongate member either side of said neutral position to initiate movement of a side shift cylinder of said ring gear in the same direction.

13. In a motor grader as claimed in claim 9 wherein movement of said control arrangement from said neutral position closes at least one switch which causes at least one hydraulic member of said blade support arrangement of adjust the position to said blade support arrangement in a sympathetic manner and direction.

14. In a motor grader as claimed in claim 13 wherein movement of said control arrangement can simultaneously initiate movement of said blade, said high lift and said ring gear.

* * * * *